US006398695B2

(12) United States Patent
Miller

(10) Patent No.: US 6,398,695 B2
(45) Date of Patent: Jun. 4, 2002

(54) ELLIPTICAL EXERCISE DEVICE

(76) Inventor: Larry Miller, 4030 Oak Tree Cir., Rochester, MI (US) 48306

( * ) Notice: Subject to any disclaimer, the term of this patent is extended or adjusted under 35 U.S.C. 154(b) by 0 days.

(21) Appl. No.: 09/759,785

(22) Filed: Jan. 12, 2001

Related U.S. Application Data

(63) Continuation of application No. 09/401,891, filed on Sep. 23, 1999, now abandoned.
(60) Provisional application No. 60/101,654, filed on Sep. 24, 1998.

(51) Int. Cl.[7] ..... A63B 69/16; A63B 22/00
(52) U.S. Cl. ..... 482/52; 482/57; 482/70
(58) Field of Search ..... 482/51, 52, 53, 482/57, 70, 79, 80

(56) References Cited

U.S. PATENT DOCUMENTS

| | | | | |
|---|---|---|---|---|
| 5,242,343 | A | 9/1993 | Miller | 482/57 |
| 5,352,169 | A | 10/1994 | Eschenbach | 482/57 |
| 5,383,829 | A | 1/1995 | Miller | 482/57 |
| 5,518,473 | A | 5/1996 | Miller | 482/57 |
| 5,527,246 | A | 6/1996 | Rodgers, Jr. | 482/57 |
| 5,540,637 | A | 7/1996 | Rodgers, Jr. | 482/52 |
| 5,562,574 | A | 10/1996 | Miller | 482/51 |
| 5,573,480 | A | 11/1996 | Rodgers, Jr. | 482/57 |
| 5,577,985 | A | 11/1996 | Miller | 482/52 |
| 5,593,371 | A | 1/1997 | Rodgers, Jr. | 482/51 |
| 5,593,372 | A | 1/1997 | Rodgers, Jr. | 482/52 |
| 5,595,553 | A | 1/1997 | Rodgers, Jr. | 482/51 |
| 5,611,756 | A | 3/1997 | Miller | 482/52 |
| 5,755,642 | A | 5/1998 | Miller | 482/51 |
| 5,788,609 | A | 8/1998 | Miller | 482/51 |
| 5,911,649 | A | 6/1999 | Miller | 482/52 |

*Primary Examiner*—Stephen R. Crow
(74) *Attorney, Agent, or Firm*—Gifford, Krass, Groh, Sprinkle, Anderson & Citkowski, P.C.

(57) ABSTRACT

An exercise device includes a frame having a pair of crank arms pivotally supported thereupon. Each crank arms engages a drive link, and each drive link engages a guide member. A foot link is pivotally connected to each guide member, and a control link pivotally connects each foot link to a drive link. In operation, the drive links and crank arms cooperate to cause the reciprocal motion of the guide members, and the control link operates to vary the angle between each foot link and its associate guide member as that guide member reciprocates. The apparatus provides a very natural running and stepping action for a user who is positioned on the foot links.

6 Claims, 4 Drawing Sheets

ELLIPTICAL EXERCISE DEVICE

RELATED APPLICATION

This patent application claims priority of provisional patent application Ser. No. 60/101,654 filed Sep. 24, 1998. This application is a continuation of Ser. No. 09/401,891, filed Sep. 23, 1999, now abandoned.

FIELD OF THE INVENTION

This invention relates generally to exercise equipment. More specifically, the invention relates to an exercise device wherein a user's foot travels in an elliptical path of travel.

BACKGROUND OF THE INVENTION

Because of a growing appreciation for the benefits of regular exercise; and because constraints of time and space prevent many persons from indulging in activities such as running, swimming and walking, the market for exercise equipment is rapidly increasing. It is generally desirable to exercise a number of different muscles over a fairly large range of motion so as to provide for even physical development and a maximum level of aerobic exercise. It is further desirable that exercise equipment provide a smooth, relatively natural motion so as to avoid jarring or irregular strains which can damage muscles and joints. It is also desirable that exercise equipment be relatively easy to use and of simple, low cost construction. While a number of different exercise systems are known in the prior art, such systems suffer from a number of shortcomings which limit their utility. Stationary bicycles are widely used; however, they are employed in a sitting position and consequently, the number of muscles exercised is small. Furthermore, the range of motion provided by a stationary bicycle is fairly limited. Stationary devices for simulating cross country skiing are also in widespread use. While these systems exercise more muscles than do stationary bicycles, the relatively flat, shuffling foot motion provided thereby does not adequately exercise all of the leg muscles through a wide range of motion. Stair climbing equipment also exercises more muscles than do stationary bicycles; however, the rather limited up and down motion provided thereby does not exercise leg muscles through a large range of motion. Treadmills and the like permit walking or jogging in a relatively limited area; however, they can be quite jarring to knee and ankle joints, and many users find it difficult to maintain balance on a treadmill.

The inventor of the present invention has previously recognized that a very beneficial form of exercise, which is simulative of a combined running and stepping motion, is achieved when a user's foot is made to travel along an elliptical path. This mode of exercise provides a non-jarring action which is very comfortable and exercises a user's muscles through a wide range of motion. In a most preferred mode of operation, a user's foot travels in a back and forth elliptical path wherein, on the forward portion of the motion, the user's heel initially rises at a faster rate than does the toe; while on the rearward portion of the cycle, the user's heel initially falls at a faster rate than does the toe. This elliptical action, and most specifically the preferred action, provides a pleasing motion which may be sustained through a full aerobic workout. In combined psychological and physiological tests, users have reported that the perceived effort required to burn a fixed number of calories is lower when elliptical mode exercisers are used, as compared to perceived effort required to burn the same number of calories when using other exercise devices such as stair steppers.

Exercise devices which achieve an elliptical foot action are disclosed in U.S. Pat. Nos. 5,243,343; 5,383,829; 5,518,473; 5,755,642; 5,788,609; 5,577,985; 5,611,756 and 5,911,649 among others. While the foregoing patents all describe apparatus for achieving an elliptical action, still other mechanical systems may be configured toward that end. Accordingly, and as will be described in detail hereinbelow, the present invention is directed to yet other novel configurations of elliptical exercise apparatus.

BRIEF DESCRIPTION OF THE INVENTION

There is disclosed herein an exercise device comprising a frame configured to be supported on a floor and having a first pivot axis defined thereupon. The apparatus further includes a first and a second crank arm, each crank arm is pivotally attached to the frame at a first pivot axis so as to be rotatable thereabout. The apparatus also includes a first and a second drive link, and each drive link has a first, second and third attachment point defined thereupon. The first attachment point of each drive link is pivotally attached to a respective one of the crank arms so that the first attachment point of that drive link rotates about the first pivot axis. The apparatus further includes a first and a second guide member, each guide member is pivotally attached to a respective one of the drive links through a second attachment point thereof. The apparatus also includes a first and a second foot link, each having a first and a second connection point defined thereupon. Each foot link is pivotally connected to a respective guide member through its first connection point. The apparatus also includes a first and a second control link, each of which is pivotally connected to a respective drive link through the third attachment point thereof, and to a respective foot link through the second connection point thereof. In operation, the guide members reciprocate back and forth, and the control links are operative to vary an angle defined between the guide members and their associated foot link as a function of the reciprocal motion of the guide members. This causes the foot of a user which is disposed on the foot link to travel in an elliptical path.

In specific embodiments of the invention, the guide members comprise roller assemblies which most preferably reciprocate along one or more tracks supported by the guide members. In other embodiments, the guide members comprise swing arms pivotally supported on the frame.

DETAILED DESCRIPTION OF THE INVENTION

This invention is directed to exercise devices of the type which simulate a running and stepping motion; and preferably a motion wherein a user's foot travels in an elliptical path of travel. An elliptical path of travel is defined to include all oval, closed curves whether symmetrical or non-symmetrical. As such, an elliptical path is distinguished from a purely circular path of travel achieved by bicycle type exercise devices. Most preferably, the path of travel is oriented such that the user's feet travel in a back and forth motion wherein, on the forward portion of the motion, the user's heel initially rises at a faster rate than does the user's toe; while on the rearward portion of the cycle, the user's heel initially falls at a faster rate than does the user's toe. This elliptical action, and most specifically the preferred action, provides a pleasing motion which may be sustained through a full aerobic workout.

Figure 1:
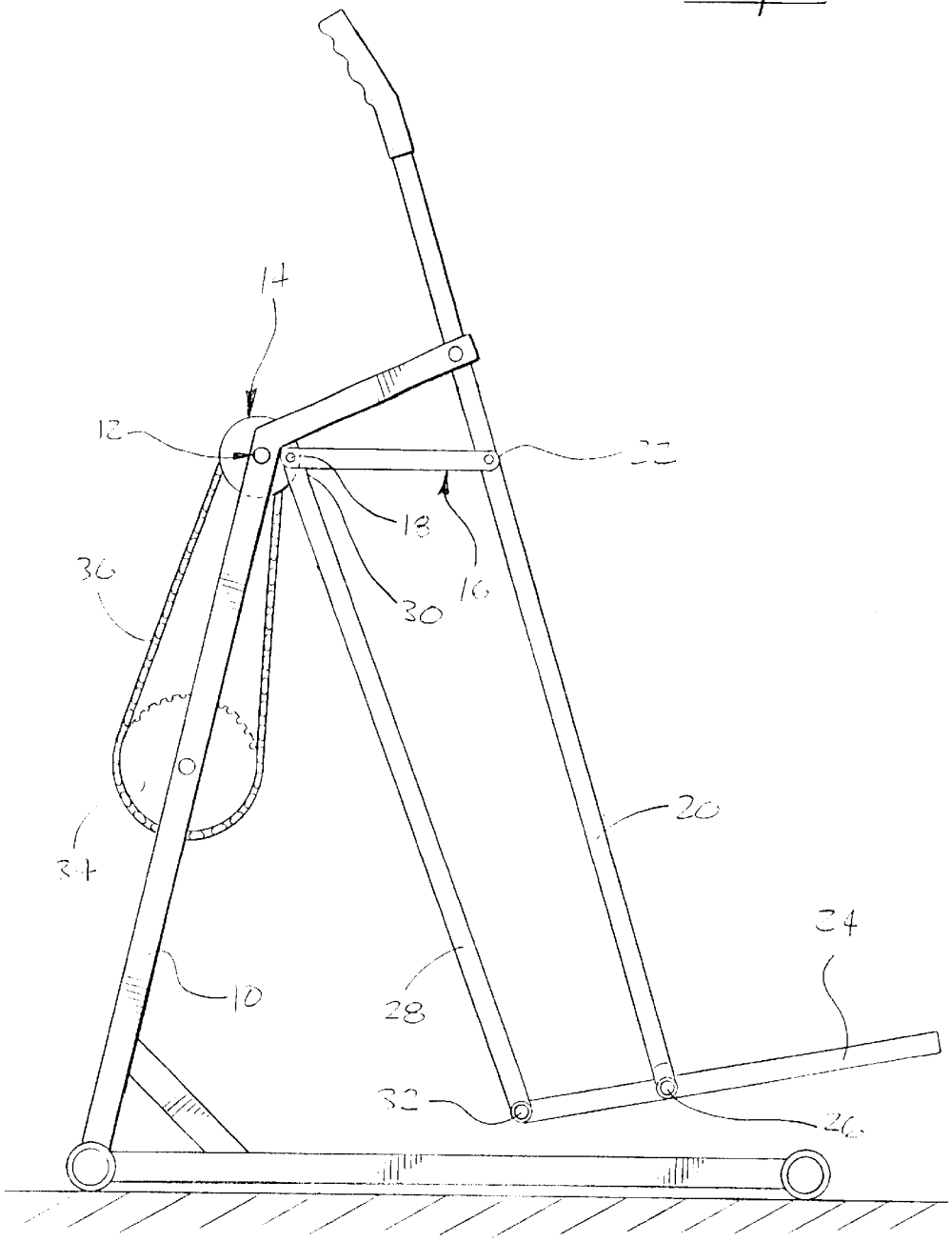
FIG. 1 depicts a first embodiment of elliptical exercise device which includes swing arms.

The apparatus of the present invention may be implemented in a number of configurations, some of which are illustrated in the accompanying figures. For example, FIG. 1 depicts a first embodiment of the apparatus configured as a self-powered, floor supported exercise device. The apparatus of FIG. 1 includes a frame 10 which is configured to be supported on a floor; and which, in turn, supports the remainder of the device. The frame 10 includes a first pivot axis 12 defined thereupon. The apparatus includes a first and a second crank arm pivotally attached to the frame at its first pivot axis 12. It is to be understood that the apparatus of FIG. 1 is configured to engage both arms and both legs of a user, and for that reason includes right and left pairs of most mechanical elements. In order to simplify the figure and clarify the description, the FIG. 1 illustration shows only one of each paired element. In the FIG. 1 embodiment, each crank arm is defined by a portion of a crank wheel, one of which is shown herein at reference numeral 14. It is to be understood that in other embodiments, the cranks may comprise discrete arms rather than portions of a crank wheel. In any event, the crank arms rotate about the first pivot axis.

The apparatus further includes a first and a second drive link, one of which, 16, is illustrated in FIG. 1. Each drive link has a first, second and third attachment point defined thereupon, and each drive link is pivotally attached to a respective one of the cranks through its first attachment point, and as illustrated herein, the first attachment point of the drive link 16 is shown at reference numeral 18 as being attached to the crank 14.

The apparatus further includes a first and a second guide member 20, and each guide member 20 is pivotally attached to its respective drive link 16 through the second attachment point 22 of the drive link 16. In the FIG. 1 embodiment, the guide member 20 is further attached to, and pivotally supported by, the frame; while in other embodiments, the guide members are otherwise supported.

The FIG. 1 embodiment further includes a first and a second foot link, one of which is shown at reference numeral 24, it being understood that the other is generally similar. Each foot link has a first and a second connection point defined thereupon and each is pivotally connected to a respective guide member 20 through its first connection point 26. The apparatus further includes a first and a second control link, one of which is shown in FIG. 1 at reference numeral 28. Each control link is pivotally connected to a respective drive link through the third attachment point of the drive link 30, and to a respective foot link 24 through the second connection point 32 thereof. In the FIG. 1 embodiment, the control link 28 is attached to the third attachment point 30 of the drive link 16, in the region of the crank 14. In this embodiment, the first attachment point 18 and the third attachment point 30 may be coincident, or they may be closely spaced. In other embodiments, the three attachment points of the drive link may be further spaced.

In the use of the apparatus, the crank travels about the first pivot axis 12 causing the first attachment point 18 of the drive link 16 to travel therewith. This provides a back and forth motion to the drive link which reciprocates the guide members and the associated foot link. At the same time, the control link moves together with the drive link and causes the angle formed by the guide member and foot link to vary as the guide member and foot link travel back and forth. This combination of motions imparts an elliptical path of travel to a foot positioned on the foot link.

It is to be understood that modifications and variations to the illustrated apparatus may be implemented. As illustrated in FIG. 1, a flywheel 34 is mechanically coupled to the crank 14 via a drive chain 36. This smooths the motion of the device. In other embodiments, a variable resistance device such as an electromagnetic brake or a friction brake may be incorporated therein; while in yet other embodiments, a motor drive may be included. In some embodiments, the attachment and connection points between the various links and members may be made adjustable so that the geometry of the resultant device can be adjusted to accommodate different users and to vary or change the elliptical path of travel.

Figure 2:
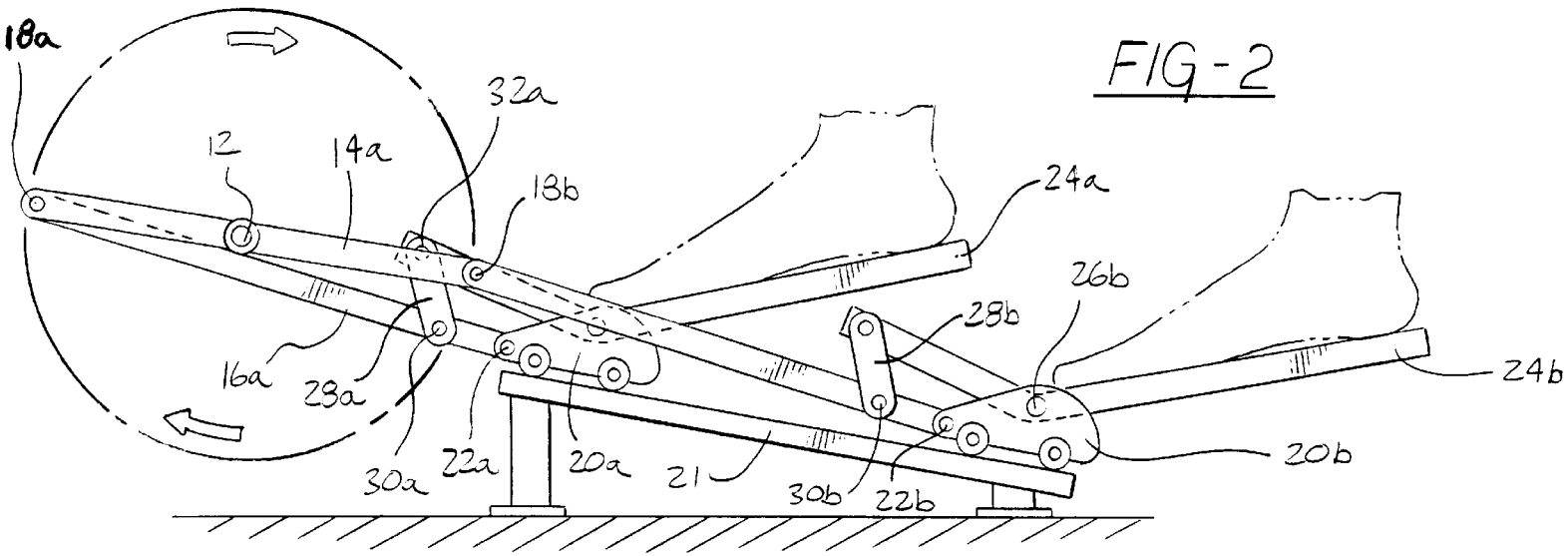
FIG. 2 depicts another embodiment of elliptical exercise device which includes roller assemblies.

Still other embodiments of the invention may be implemented. For example, FIG. 2 schematically depicts yet another embodiment of the invention. In describing this embodiment, elements corresponding to those shown in FIG. 1 will be referred to by like names and by like reference numerals. The FIG. 2 embodiment includes a frame, which is not shown herein for purposes of clarity, it being understood that variously configured frames may be utilized to support the different members of the embodiment. The FIG. 2 embodiment includes a pair of crank arms 14*a*, 14*b* disposed so as to rotate about a first pivot axis 12. Each crank arm is pivotally coupled to a respective drive link 16*a*, 16*b* through the first attachment points 18*a*, 18*b* thereof. The FIG. 2 embodiment further includes guide members 20*a*, 20*b*, each of which is pivotally attached to a respective drive link 16*a*, 16*b* through a second attachment point 22*a*, 22*b* thereof. In this embodiment, the guide members are configured as roller members, rather than the swing arms of the FIG. 1 embodiment; however, their function is analogous insofar as they reciprocate relative to the frame and move associated foot links therewith. As illustrated, the guide members 20 are supported by a track 21, which may be a single wide track or a pair of separate tracks, and which can be an integral portion of the frame or a member separate therefrom. The apparatus of FIG. 2 may also include an adjustment member for varying the angle of the track relative to the frame so as to permit adjustment of the path of travel of the guide members.

The FIG. 2 embodiment includes first and second foot links 24*a*, 24*b* which are pivotally connected to their respective guide members 22 through a first connection point 26*a*, 26*b* defined thereupon.

The FIG. 2 embodiment further includes a first and a second control link 28*a*, 28*b* which, as in the previous embodiment, are connected to respective drive links 16*a*, 16*b* via a second attachment point 22*a*, 22*b* thereof, and to a respective foot link 24 via a second connection point 32 thereupon. As in the previous embodiment, the control links 28 function to vary the angle between the foot link and the guide member as the foot link and guide member reciprocate relative to the frame.

Figure 3:
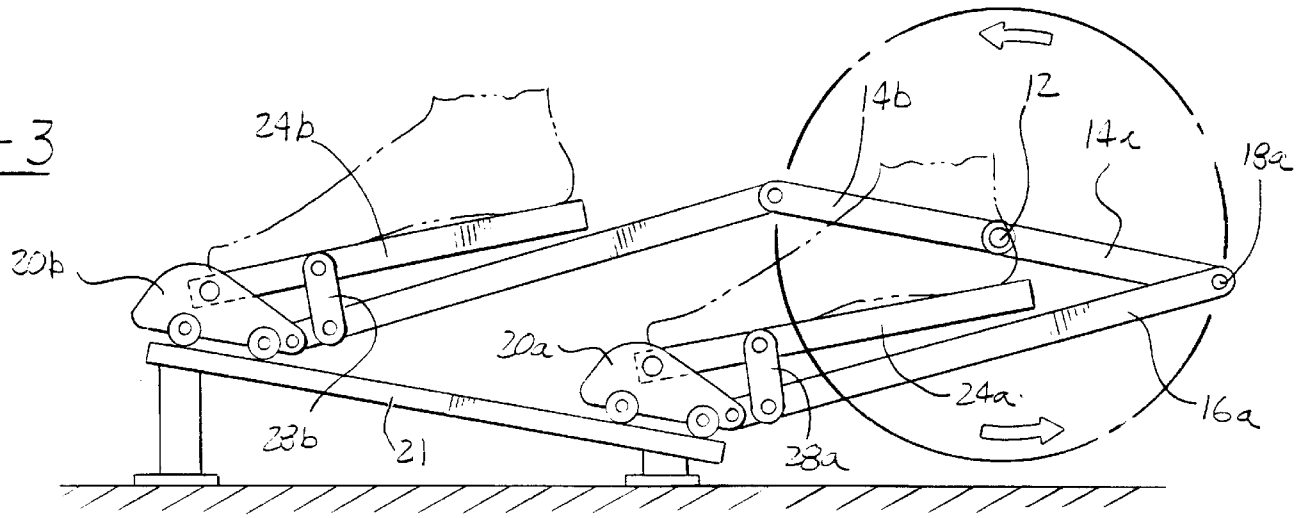
FIG. 3 depicts another embodiment of elliptical exercise device including roller assemblies and rearwardly disposed crank arms.

Referring now to FIG. 3, there is shown yet another embodiment of exercise device structured in accord with the principles of the present invention. The FIG. 3 embodiment is generally similar to the FIG. 2 embodiment insofar as the guide members comprise roller assemblies which travel on tracks. In the FIG. 3 embodiment, the crank arms are disposed rearward of the user and the control link is connected to the foot link inboard of the connection to the guide member.

Yet other embodiments of the present invention may be implemented. For example, FIG. 4 depicts an exercise device wherein the guide members are swing arms generally similar to the guide members of FIG. 1; however, unlike the FIG. 1 embodiment, the drive links are disposed beneath the foot links, and the control links are relatively short members.

Figure 4:
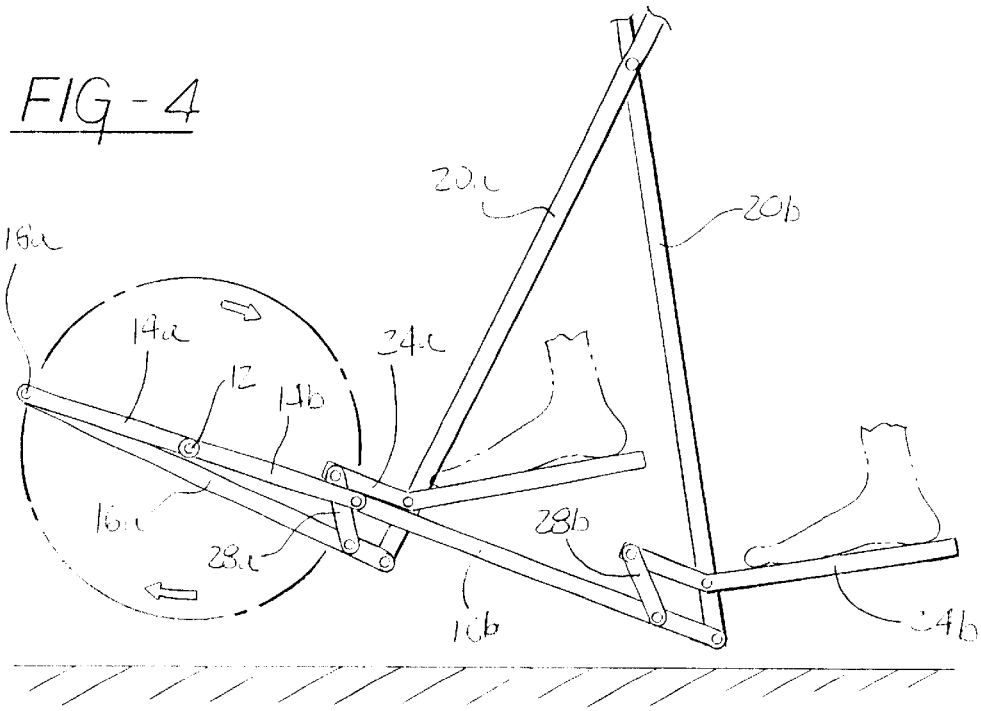
FIG. 4 depicts another embodiment of elliptical exercise device including guide members which are swing arms, and a forwardly disposed set of crank arms.
Figure 5:
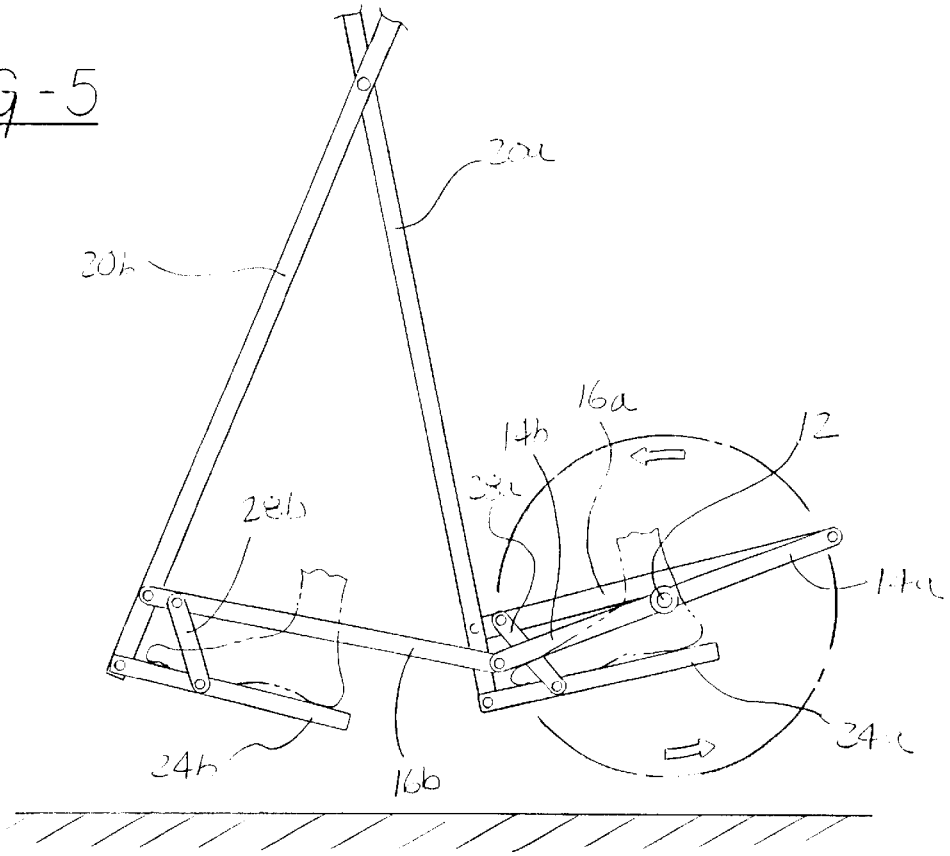
FIG. 5 depicts another embodiment of elliptical exercise device having swing arms and rearwardly disposed cranks.
Figure 6:
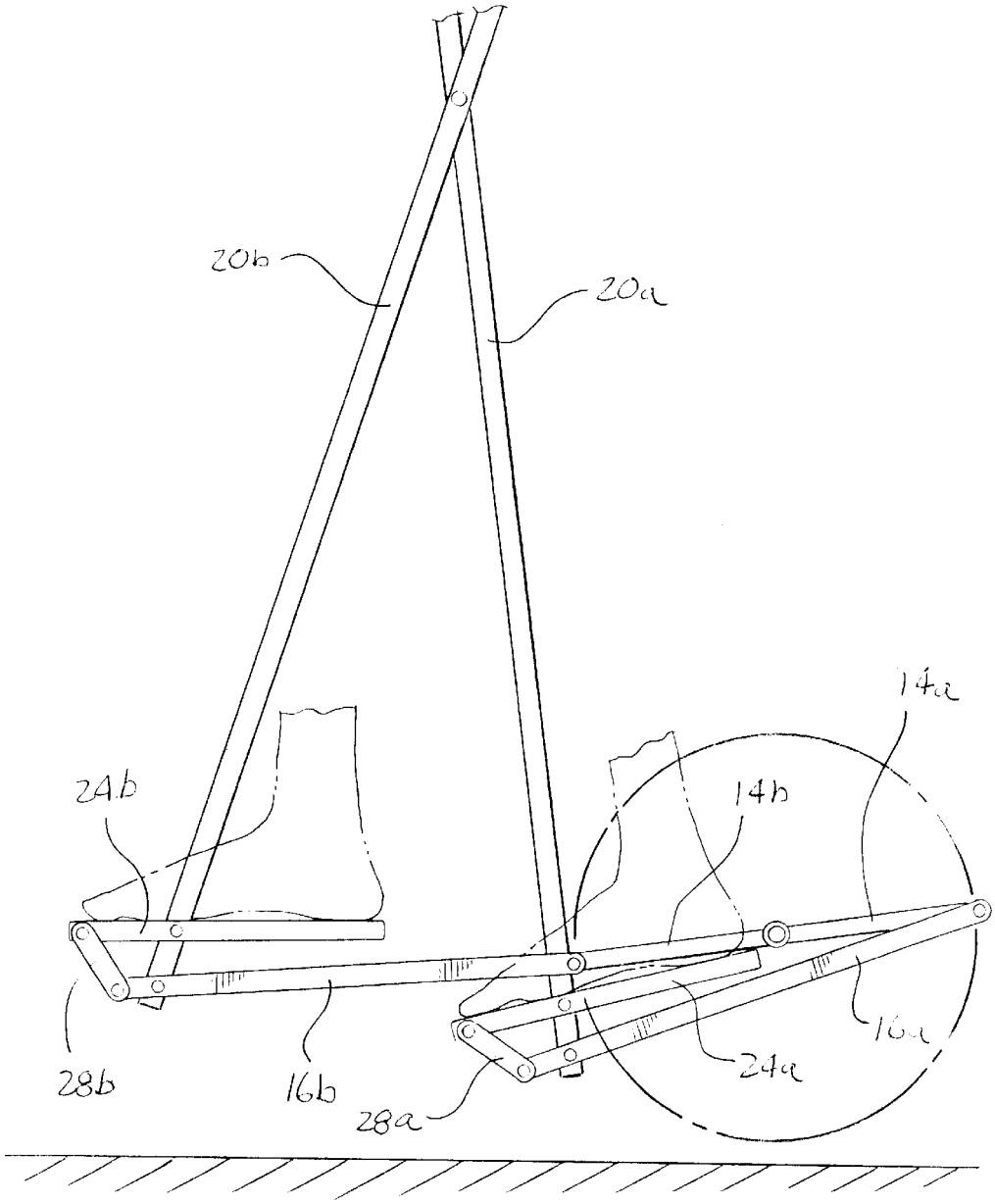
FIG. 6 depicts yet another embodiment of elliptical exercise device having swing arms and rearwardly disposed cranks.

The FIG. 5 embodiment is generally similar to the FIG. 4 embodiment, except that the crank is disposed rearward of the user and the drive links are above the foot links. FIG. 6 is yet another embodiment of the invention, and is generally similar to the FIG. 4 and FIG. 5 embodiments. In the FIG. 6 embodiment, the crank arms are located rearward of the user, the control links are outboard of the guide member, and the foot links are disposed above the drive links. Yet other embodiments of the present invention may be implemented, and in view of the teaching presented herein, such embodiments will be obvious to one of skill in the art. The foregoing drawings, discussion and description are illustrative of particular embodiments of the invention, but are not meant to be limitations upon the practice thereof. It is the following claims, including all equivalents, which define the scope of the invention.

What is claimed is:

1. An exercise device comprising a frame configured to be supported on a floor, said frame having a first pivot axis defined thereupon;

a first and a second crank arm, each crank arm being pivotally attached to the frame at the first pivot axis so as to be rotatable thereabout;

a first and a second drive link, each drive link having a first, second and third attachment point defined thereupon, the first attachment point of each drive link being pivotally attached to a respective one of said crank arms; whereby said first attachment point of each drive link rotates about said first pivot axis;

a first and a second guide member, each guide member being pivotally attached to a respective one of said drive links through the second attachment point thereof;

said guide members comprise roller assemblies, and wherein said frame further includes track means which support said guide members;

a first and a second foot link, each foot link having a first and a second connection point defined thereupon, each foot link being pivotally connected to a respective guide member through its first connection point; and a first and a second control link, each control link pivotally connected to a respective drive link through the third attachment point thereof and to a respective foot link through the second connection point thereof.

2. An exercise device as in claim 1, wherein said guide members comprise roller assemblies, and wherein said frame further includes track means which support said guide members.

3. An exercise device as in claim 1, wherein each of said drive link and its associated control link are disposed beneath their respective foot link.

4. An exercise device comprising a frame configured to be supported on a floor, said frame having a first pivot axis defined thereupon;

a first and a second crank arm, each crank arm being pivotally attached to the frame at the first pivot axis so as to be rotatable thereabout;

a first and a second drive link, each drive link having a first, second and third attachment point defined thereupon, the first attachment point of each drive link being pivotally attached to a respective one of said crank arms; whereby said first attachment point of each drive link rotates about said first pivot axis;

a first and a second guide member, each guide member comprising a roller assembly which is pivotally attached to a respective one of said drive links through the second attachment point thereof;

a first and a second foot link, each foot link having a first and a second connection point defined thereupon, each foot link being pivotally connected to a respective guide member through its first connection point; and a first and a second control link, each control link pivotally connected to a respective drive link through the third attachment point thereof and to a respective foot link through the second connection point thereof.

5. An exercise device as in claim 4, wherein said frame further includes track means which support said guide members.

6. An exercise device as in claim 4, wherein each of said crank arms is defined by a portion of a crank wheel.

* * * * *